US009568238B2

(12) United States Patent
Kim et al.

(10) Patent No.: US 9,568,238 B2
(45) Date of Patent: Feb. 14, 2017

(54) REFRIGERATOR

(71) Applicant: SAMSUNG ELECTRONICS CO., LTD., Suwon (KR)

(72) Inventors: Byoung Mok Kim, Kwangju (KR); Young Jae Song, Gwangju (KR); Seung Yong Yang, Gwangju (KR); Gang U Lee, Daejeon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/075,302

(22) Filed: Nov. 8, 2013

(65) Prior Publication Data

US 2014/0132144 A1 May 15, 2014

(30) Foreign Application Priority Data

Nov. 9, 2012 (KR) ..... 10-2012-0126893

(51) Int. Cl.

| | |
|---|---|
| ***A47B 96/04*** | (2006.01) |
| ***A47B 97/00*** | (2006.01) |
| ***F25D 23/02*** | (2006.01) |
| *F25D 23/04* | (2006.01) |

(52) U.S. Cl.

CPC ..... *F25D 23/028* (2013.01); *F25D 23/025* (2013.01); *F25D 23/04* (2013.01); *F25D 2323/024* (2013.01); *F25D 2500/02* (2013.01)

(58) Field of Classification Search

CPC ..... F25D 23/028; F25D 2323/021

USPC ..... 312/405, 401, 291, 292, 405.1

See application file for complete search history.

(56) References Cited

U.S. PATENT DOCUMENTS

| | | | | |
|---|---|---|---|---|
| 2,131,680 | A * | 9/1938 | Zahodiakin | 62/266 |
| 2,150,064 | A * | 3/1939 | John et al. | 62/266 |
| 4,774,740 | A * | 10/1988 | Gidseg et al. | 16/344 |
| 5,138,743 | A * | 8/1992 | Hoffman | 16/303 |
| 5,369,842 | A * | 12/1994 | Beatty | 16/317 |
| 2011/0023528 | A1* | 2/2011 | Kwon et al. | 62/441 |
| 2013/0154464 | A1* | 6/2013 | Fiori et al. | 312/405 |

FOREIGN PATENT DOCUMENTS

| | | |
|---|---|---|
| JP | 2011-69612 | 4/2011 |
| KR | 10-2009-0077564 | 7/2009 |

* cited by examiner

*Primary Examiner* — Daniel J Troy
*Assistant Examiner* — Timothy M Ayres

(57) ABSTRACT

A refrigerator in which an opening having a size corresponding to the size of a refrigerator compartment is provided in a refrigerator compartment door and an outer door to open/close the opening is rotatably coupled to the refrigerator compartment door so that a plurality of door guards provided in a space corresponding to the size of the refrigerator compartment may be used by only opening/closing the outer door, and the refrigerator compartment door and the outer door may be rotated on one hinge shaft and the outer door has an auto closing structure so that the outer door may be automatically closed when a predetermined portion of the outer door is opened.

13 Claims, 13 Drawing Sheets

REFRIGERATOR

CROSS-REFERENCE TO RELATED APPLICATIONS

This application claims the priority benefit of Korean Patent Application No. 10-2012-0126893, filed on Nov. 9, 2012 in the Korean Intellectual Property Office, the disclosure of which is incorporated herein by reference.

BACKGROUND

1. Field

The following description relates to a refrigerator.

2. Description of the Related Art

In general, a refrigerator is a home appliance that keeps food fresh by including a storage compartment and a cold air supply device to supply cold air to the storage compartment.

The temperature of the storage compartment is maintained in a predetermined range of temperature required to keep food fresh.

The storage compartment of the refrigerator is disposed in such a way that a front portion of the storage compartment is opened, and the open front portion of the storage compartment is closed by a door so as to maintain the normal temperature of the storage compartment.

The storage compartment is partitioned in right and left directions by a partition, and the storage compartment that is partitioned in right and left directions is opened/closed by doors, for example, side-by-side doors that are rotatably hinge-coupled to each other.

An opening is provided in a refrigerator compartment door that opens/closes a refrigerator compartment of the storage compartment, and the opening is opened/closed by a home bar door.

Since the opening that is opened/closed by the home bar door is provided to a size at which only a predetermined space of the refrigerator compartment may be used, there are inconveniences of opening the whole refrigerator compartment door so as to take out food accommodated in a space other than the predetermined space that may be used through the opening.

SUMMARY

Therefore, it is an aspect of the present disclosure to provide a refrigerator in which an opening having a size corresponding to the size of a refrigerator compartment is provided in a refrigerator compartment door and an outer door to open/close the opening is rotatably coupled to the refrigerator compartment door so that the whole of a plurality of door guards provided in a space corresponding to the size of the whole refrigerator compartment may be used by only opening/closing the outer door.

It is another aspect of the present disclosure to provide a refrigerator that enables rotation of the refrigerator compartment door and the outer door on one hinge shaft.

It is still another aspect of the present disclosure to provide a refrigerator in which the outer door has an auto closing structure so that the outer door may be automatically closed when a predetermined portion of the outer door is opened.

Additional aspects of the disclosure will be set forth in part in the description which follows and, in part, will be apparent from the description, or may be learned by practice of the disclosure.

In accordance with one aspect of the present disclosure, there is provided a refrigerator including: a body; a storage compartment that is provided in the body so that a front side of the storage compartment is opened and includes a refrigerator compartment and a freezer compartment; an inner door that is provided to have an opening having a size corresponding to the refrigerator compartment and opens/closes the refrigerator compartment, the opening having a plurality of door guards; an outer door that opens/closes the opening; a first upper hinge including a first coupling part coupled to an upper portion of the body and a first extension part that extends from the first coupling part to the inner door and is rotatably coupled to the inner door due to an upper hinge shaft; a second upper hinge including a second coupling part coupled to an upper portion of the outer door and a second extension part that extends from the second coupling part to the inner door and is rotatably coupled to the upper hinge shaft coupled to the first upper hinge; an upper door cap that is coupled to an upper portion of the inner door and has a hinge accommodation part in which the first extension part and the second extension part are accommodated; a cam unit that is coupled to the hinge accommodation part and includes an insertion tube into which the upper hinge shaft is rotatably inserted and a first cam surface formed along a circumference of the insertion tube; and a first connector that is coupled to the second upper hinge to be movable in a vertical direction, if the outer door is opened, rotates together with the outer door and moves in an upward direction along the first cam surface, moves in a downward direction due to gravity, and transmits a rotational force to the outer door in a direction in which the outer door is closed.

The first extension part of the first upper hinge has a coupling hole to which the upper hinge shaft is coupled and the second upper hinge has a first insertion hole into which the upper hinge shaft is rotatably inserted and is provided in a position corresponding to the coupling hole.

A connector coupling part may be provided in the first insertion hole and may extend from the first insertion hole to have a curved shape so that the first connector may be coupled to the connector coupling part so as to be movable in a vertical direction.

The first connector may include a coupling protrusion having a shape corresponding to the connector coupling part so that the coupling protrusion may be coupled to the connector coupling part so as to be movable in the vertical direction, a second insertion hole into which the upper hinge shaft is rotatably inserted, a hanging part that limits a moving distance of the first connector in an upward direction, and a protrusion part that is provided to have a shape corresponding to the first cam surface and moves along the first cam surface.

The second insertion hole may be provided to have a smaller diameter than a diameter of the first insertion hole so that the first connector may be coupled to the second upper hinge so as to be movable in the vertical direction.

A cam unit coupling part to which the cam unit is coupled may be provided in the hinge accommodation part, and an upper portion of the insertion tube of the cam unit may be provided to have a smaller diameter than a diameter of the second insertion hole so that the first connector is movable in the vertical direction.

The first cam surface may include two concave parts that face each other, and convex parts may be provided between the concave parts.

The protrusion part of the first connector provided to have a shape corresponding to the first cam surface may be disposed so that, if the outer door is closed, a convex part of the protrusion part contacts the concave parts.

If the outer door is opened, the convex part of the protrusion part may move from the concave parts to the convex parts of the first cam surface, and the first connector may move in an upward direction.

If the outer door is opened at 90 degrees, the convex part of the protrusion part may move to upper portions of the convex parts of the first cam surface and moves to the concave parts due to gravity, and the first connector may move in a downward direction.

The first connector may move in the downward direction and may transmit a rotational force to the outer door in a direction in which the outer door is closed such that the outer door may be closed.

A lower door cap may be coupled to a lower portion of the inner door, and an insertion part into which a lower hinge shaft is inserted may be provided in the lower door cap.

A first lower hinge to which the lower hinge shaft is coupled may be coupled to a lower portion of the body, and a coupling unit having a third insertion hole into which the lower hinge shaft is rotatably inserted may be coupled to a lower portion of the lower door cap.

A second lower hinge having a fourth insertion hole into which the lower hinge shaft is rotatably inserted may be coupled to a lower portion of the outer door.

A second cam surface may be provided on the first lower hinge, and a second connector may be coupled to the coupling unit, may move along the second cam surface, and may transmit a rotational force to the inner door in a direction in which the inner door is closed.

In accordance with another aspect of the present disclosure, there is provided a refrigerator including: a body; a storage compartment that is provided in the body so that a front portion of the storage compartment is opened and includes a refrigerator compartment and a freezer compartment; an inner door that is provided to have an opening having a size corresponding to the refrigerator compartment and opens/closes the refrigerator compartment, the opening having a plurality of door guards; an outer door that opens/closes the opening; an upper hinge including a first upper hinge that is coupled to an upper portion of the body and allows the inner door to be rotatably coupled to the body and a second upper hinge that is coupled to an upper portion of the outer door and allows the outer door to be rotatably coupled to the inner door; and a lower hinge including a first lower hinge that is coupled to a lower portion of the body and allows the inner door to be rotatably coupled to the body and a second lower hinge that is coupled to a lower portion of the outer door and allows the outer door to be rotatably coupled to the inner door, wherein the first upper hinge and the second upper hinge share an upper hinge shaft as one hinge shaft and the first lower hinge and the second lower hinge share a lower hinge shaft as one hinge shaft.

The first upper hinge may include a first coupling part coupled to the upper portion of the body and a first extension part that extends from the first coupling part to the inner door and is rotatably coupled to the inner door due to the upper hinge shaft, the second upper hinge may include a second coupling part coupled to the upper portion of the outer door and a second extension part that extends from the second coupling part to the inner door and is rotatably coupled to the upper hinge shaft, and the first extension part and the second extension part may be accommodated in a hinge accommodation part of an upper door cap coupled to an upper portion of the inner door.

A cam unit may be coupled to the hinge accommodation part and may include an insertion tube into which the upper hinge shaft is rotatably inserted and a first cam surface formed along a circumference of the insertion tube.

The refrigerator may further include a first connector that is coupled to the second upper hinge so as to be movable in a vertical direction so that, if the outer door is opened, the first connector may rotate together with the outer door, moves along the first cam surface in an upward direction, moves in a downward direction due to gravity, and transmits a rotational force to the outer door in a direction in which the outer door is closed.

In accordance with still another aspect of the present disclosure, there is provided a refrigerator including: a body; a storage compartment that is provided in the body so that a front portion of the storage compartment is opened and includes a refrigerator compartment and a freezer compartment; an inner door that is provided to have an opening having a size corresponding to the refrigerator compartment and opens/closes the refrigerator compartment, the opening having a plurality of door guards; an outer door that opens/closes the opening; an upper hinge including a first upper hinge that is coupled to an upper portion of the body and allows the inner door to be rotatably coupled to the body and a second upper hinge that is coupled to an upper portion of the outer door and allows the outer door to be rotatably coupled to the inner door; and a lower hinge including a first lower hinge that is coupled to a lower portion of the body and allows the inner door to be rotatably coupled to the body and a second lower hinge that is coupled to a lower portion of the outer door and allows the outer door to be rotatably coupled to the inner door, wherein the outer door is automatically closed due to a cam unit coupled to an upper portion of the inner door and having a first cam surface and a first connector that is coupled to the second upper hinge, moves along the first cam surface in a vertical direction, and transmits a rotational force to the outer door in a direction in which the outer door is closed, and the inner door is automatically closed due to a second cam surface formed on the first lower hinge and a second connector that moves along the second cam surface and transmits a rotational force to the inner door in a direction in which the inner door is closed.

The first upper hinge and the second upper hinge may share an upper hinge shaft as one hinge shaft and the first lower hinge and the second lower hinge may share a lower hinge shaft as one hinge shaft.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
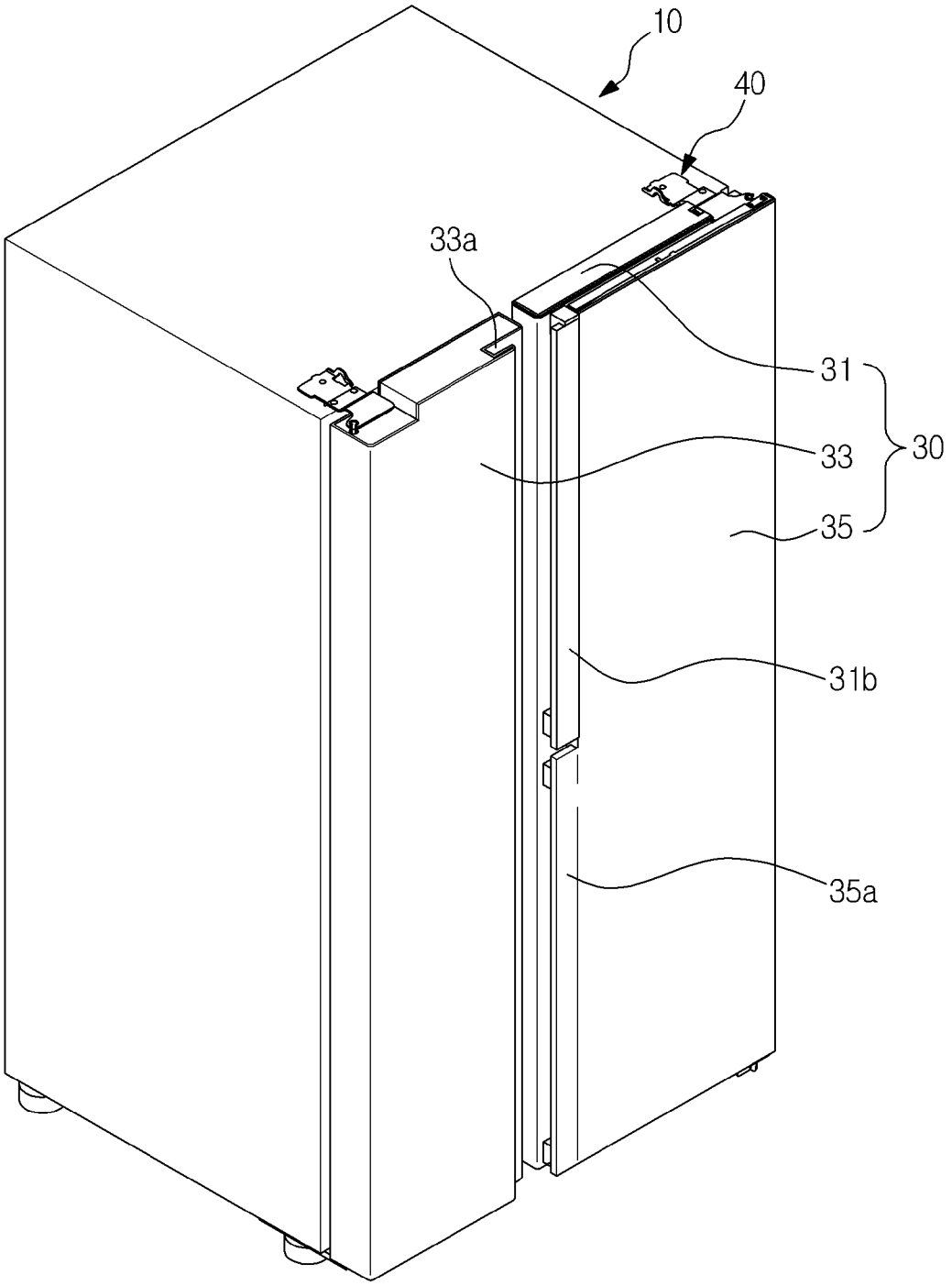
FIG. 1 is a perspective view of a refrigerator according to an embodiment of the present disclosure.

Reference will now be made in detail to embodiments, examples of which are illustrated in the accompanying drawings, wherein like reference numerals refer to the like elements throughout. Embodiments are described below to explain the present disclosure by referring to the figures.

The present disclosure will now be described more fully with reference to the accompanying drawings, in which exemplary embodiments of the disclosure are shown.

Figure 2:
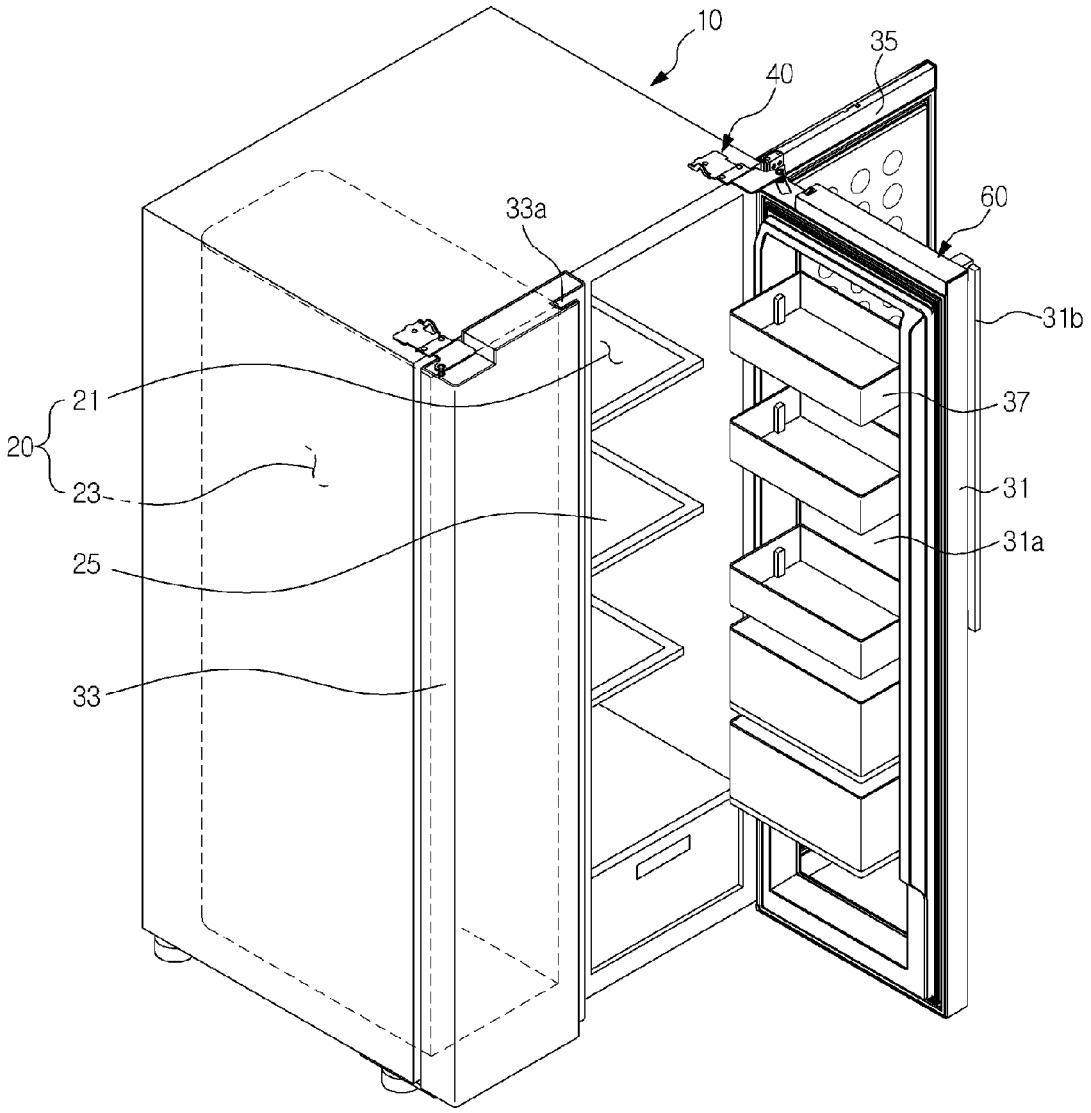
FIG. 2 is a perspective view illustrating a state in which a refrigerator compartment door and an outer door of the refrigerator illustrated in FIG. 1 are opened.
Figure 3:
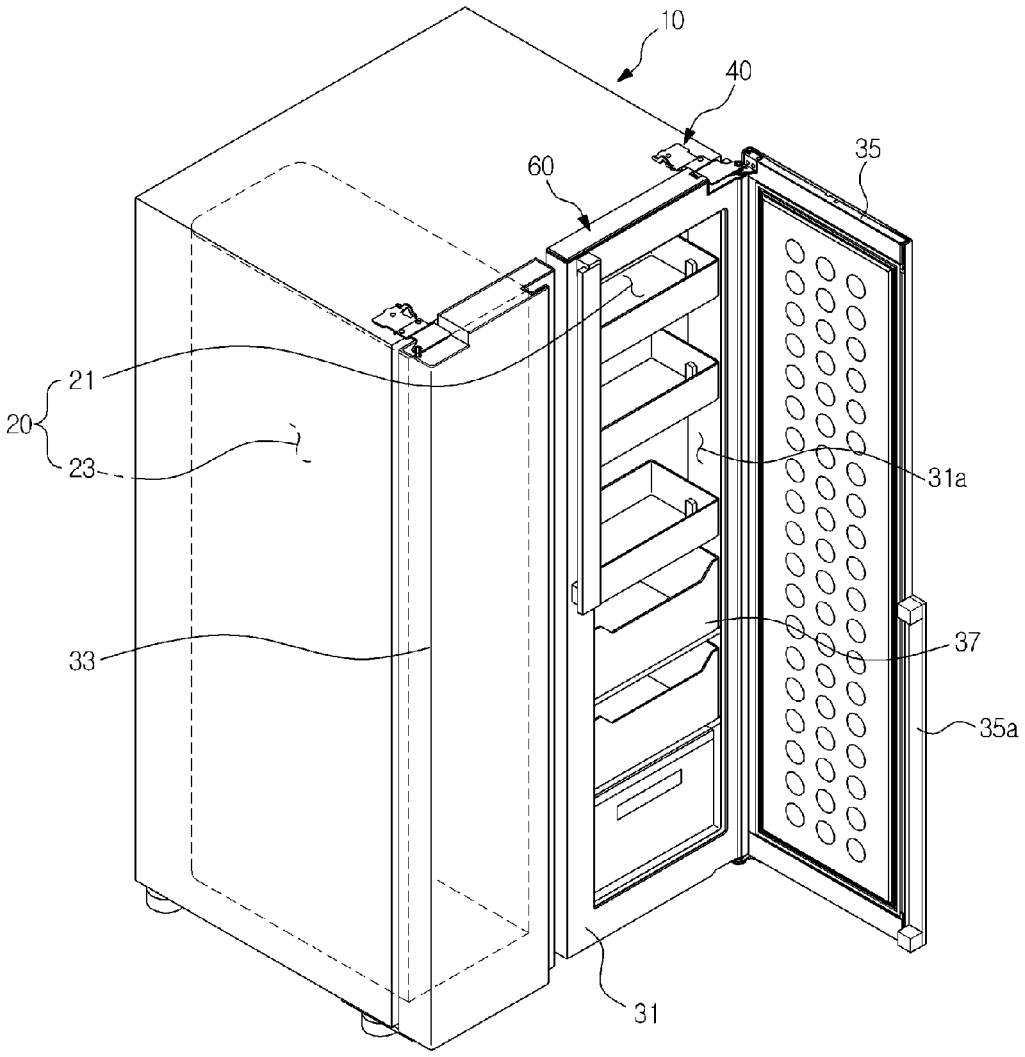
FIG. 3 is a perspective view illustrating a state in which the outer door of the refrigerator of FIG. 1 is opened.
Figure 4:
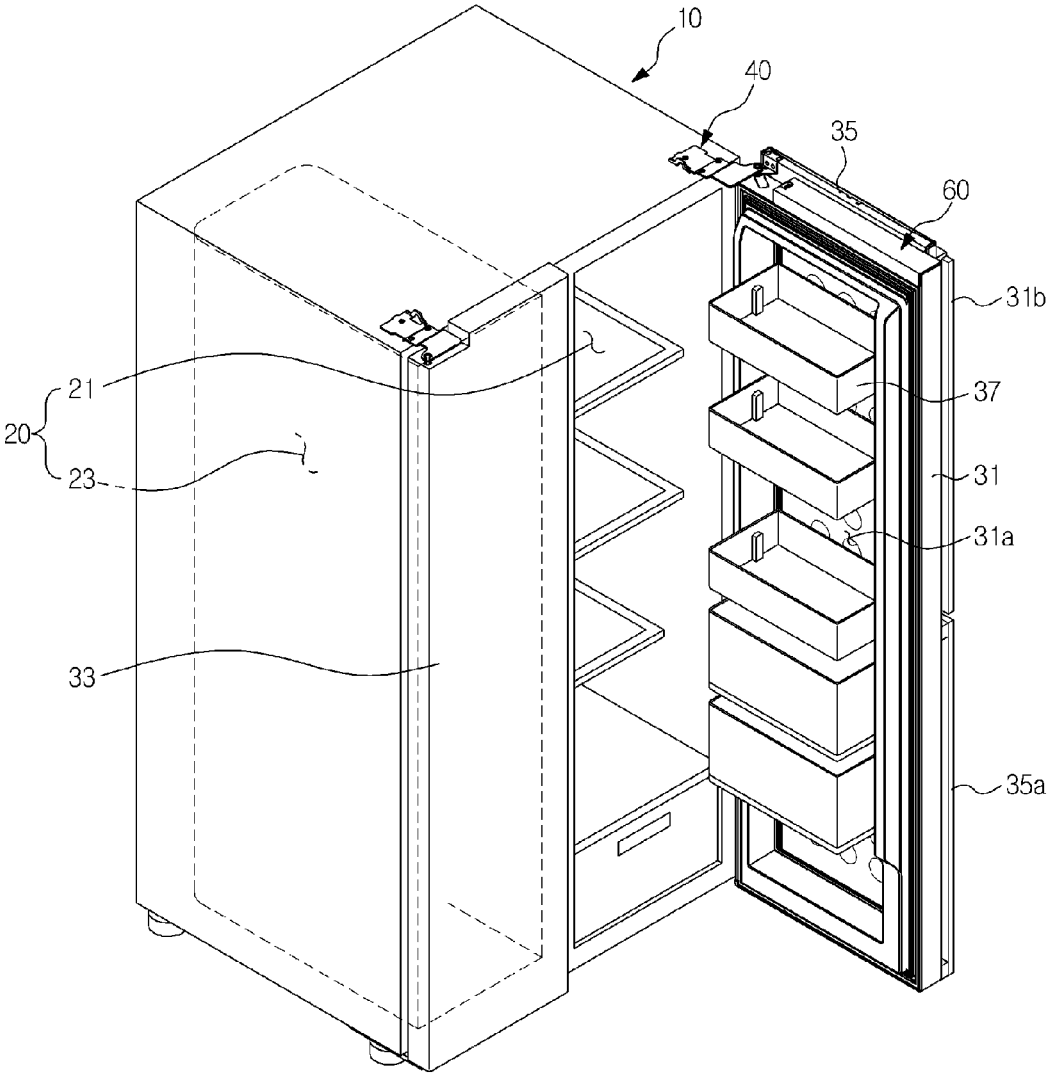
FIG. 4 is a perspective view illustrating a state in which the refrigerator compartment door of the refrigerator of FIG. 1 is opened.
Figure 5:
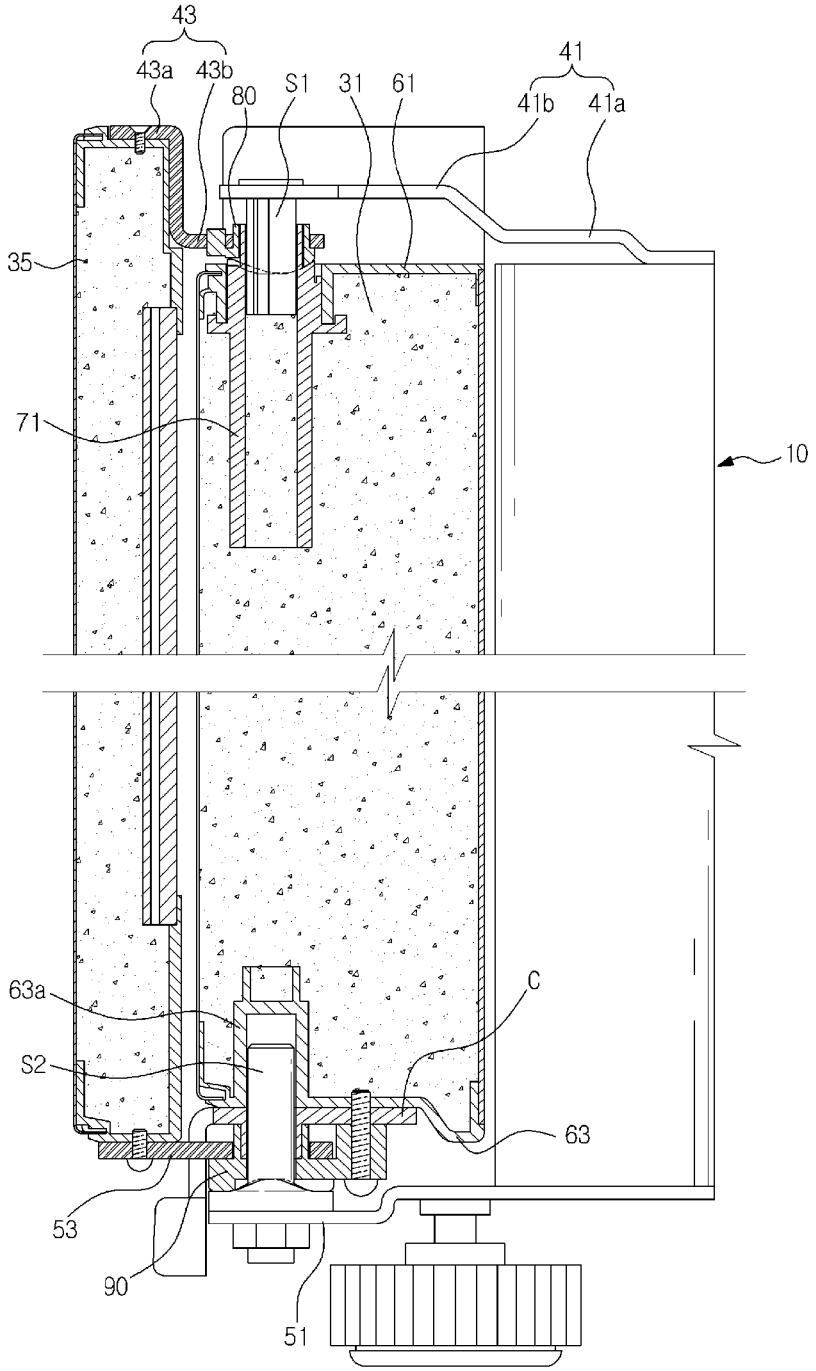
FIG. 5 is a cross-sectional view illustrating an upper hinge and a lower hinge that are coupled to the refrigerator of FIG. 1.
Figure 6:
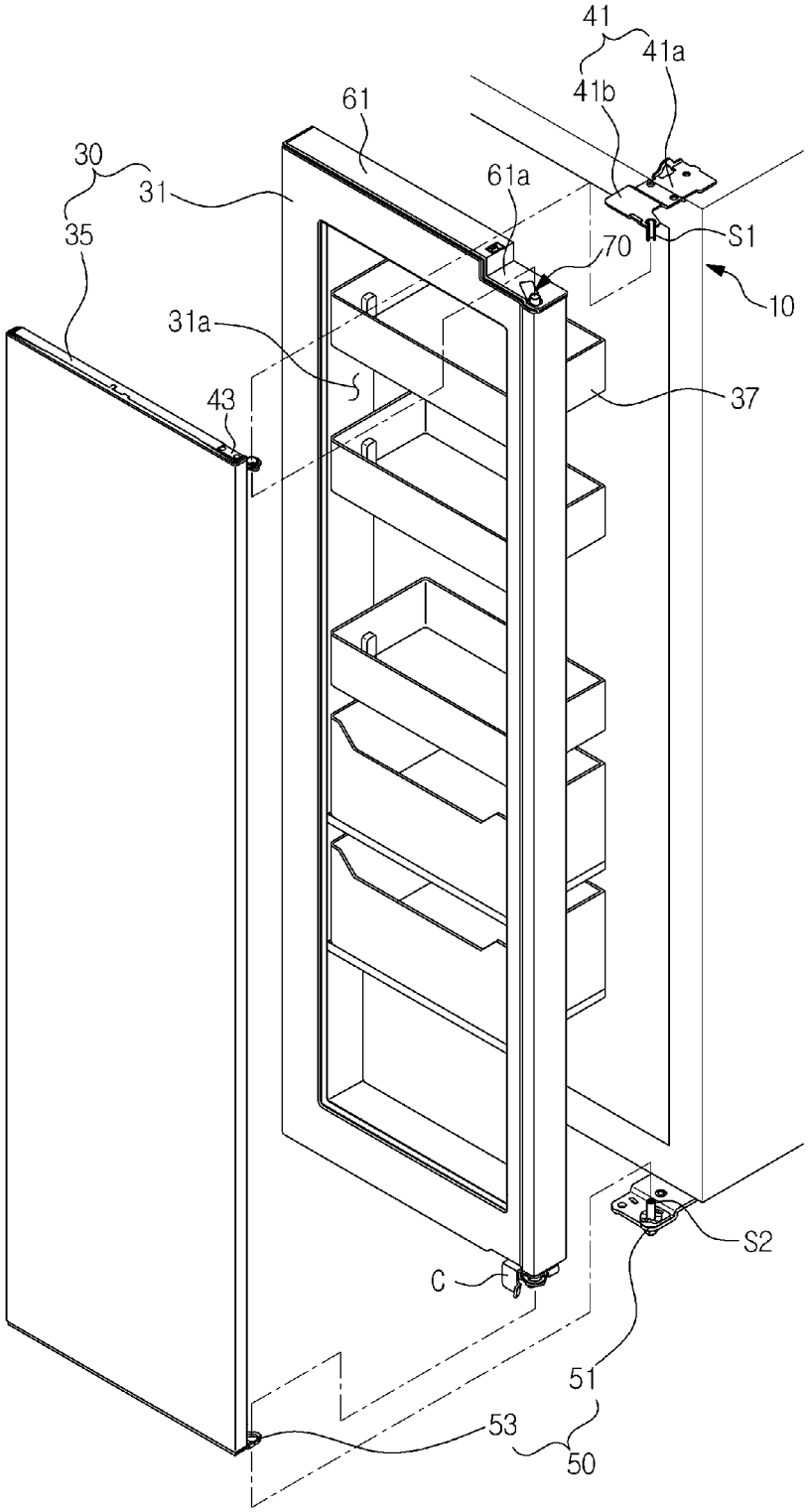
FIG. 6 is an exploded perspective view of the refrigerator compartment door and the outer door of the refrigerator of FIG. 1.

FIG. 1 is a perspective view of a refrigerator according to an embodiment of the present disclosure, FIG. 2 is a perspective view illustrating a state in which a refrigerator compartment door and an outer door of the refrigerator illustrated in FIG. 1 are opened, FIG. 3 is a perspective view illustrating a state in which the outer door of the refrigerator of FIG. 1 is opened, FIG. 4 is a perspective view illustrating a state in which the refrigerator compartment door of the refrigerator of FIG. 1 is opened, FIG. 5 is a cross-sectional view illustrating an upper hinge and a lower hinge that are coupled to the refrigerator of FIG. 1, and FIG. 6 is an exploded perspective view of the refrigerator compartment door and the outer door of the refrigerator of FIG. 1.

As illustrated in FIGS. 1 through 6, the refrigerator includes a body 10, a storage compartment 20 that is provided in the body 10 in such a way that a front portion of the storage compartment 20 is opened, a door 30 including a refrigerator compartment door 31 that is provided to have an opening 31*a* and opens/closes the storage compartment 20 and an outer door 35 that opens/closes the opening 31*a* provided in the refrigerator compartment door 31, an upper hinge 40 and a lower hinge 50 that allow the door 30 to be rotatably coupled to the body 10, door caps 60 that are coupled to upper and lower portions of the door 30, a cam unit 70 and a first connector 80 that transmit a rotational force to the outer door 35 in a direction in which the outer door 35 is closed, and a second connector 90 that transmits a rotational force to the refrigerator compartment door 31 in a direction in which the refrigerator compartment door 31 is closed.

The body 10 includes an inner case (not shown) that constitutes the storage compartment 20, an outer case (not shown) that constitutes the exterior, and a cold air supply device (not shown) that supplies cold air to the storage compartment 20.

The cold air supply device may include a compressor, a condenser, an expansion valve, an evaporator, a blower fan, and a cold air duct. A heat insulating material (not shown) foams in a space between the inner case and the outer case of the body 10 so as to prevent cold air from flowing out from the storage compartment 20.

A machine compartment (not shown) in which the compressor to compress a refrigerant and the condenser to condense the compressed refrigerant are installed, is provided at a rear lower portion of the body 10.

The storage compartment 20 is partitioned in right and left directions by a partition, the refrigerator compartment 21 is provided at the right portion of the body 10, and a freezer compartment 23 is provided at the left portion of the body 10.

A plurality of shelves 25 may be provided in the refrigerator compartment 21 and may partition the refrigerator compartment 21 into a plurality of compartments.

The refrigerator compartment 21 and the freezer compartment 23 are opened/closed by the refrigerator compartment door 31 and the freezer compartment door 33 that are rotatably coupled to the body 10, respectively, and the upper hinge 40 and the lower hinge 50 are coupled to upper and lower portions of the body 10 so that the refrigerator compartment door 31 and the freezer compartment door 33 may be rotatably coupled to the body 10.

The opening 31*a* having a size corresponding to the size of the refrigerator compartment 21 is provided in the refrigerator compartment door 31, and a plurality of door guards 37 are provided in the opening 31*a*.

A refrigerator compartment door handle 31*b* and a freezer compartment door handle 33*a* are provided on the refrigerator compartment door 31 and the freezer compartment door 33, respectively, so that a user may grasp the refrigerator compartment door handle 31*b* and the freezer compartment door handle 33*a* so as to open the refrigerator compartment door 31 and the freezer compartment door 33.

The opening 31*a* provided in the refrigerator compartment door 31 is opened/closed by the outer door 35. For conveniences, the refrigerator compartment door 31 is referred to as an inner door.

An outer door handle 35*a* is provided on the outer door 35 so that the user may grasp the outer door handle 35*a* so as to open the outer door 35, separate from the refrigerator compartment door 31 and the freezer compartment door 33.

Since the opening 31*a* provided in the inner door 31 has the size corresponding to that of the refrigerator compartment 21, the outer door 35 is opened so that the whole of the plurality of door guards 37 provided in a space corresponding to the size of the whole refrigerator compartment 21 other than a predetermined space may be used.

The upper hinge 40 and the lower hinge 50 are coupled to the upper and lower portions of the body 10 so that the refrigerator compartment door 31 and the freezer compartment door 33 may be rotatably coupled to the body 10. The upper hinge 40 and the lower hinge 50 are coupled to the outer door 35 and the refrigerator compartment door 31 as the inner door 31 in which the outer door 35 is provided.

Figure 7:
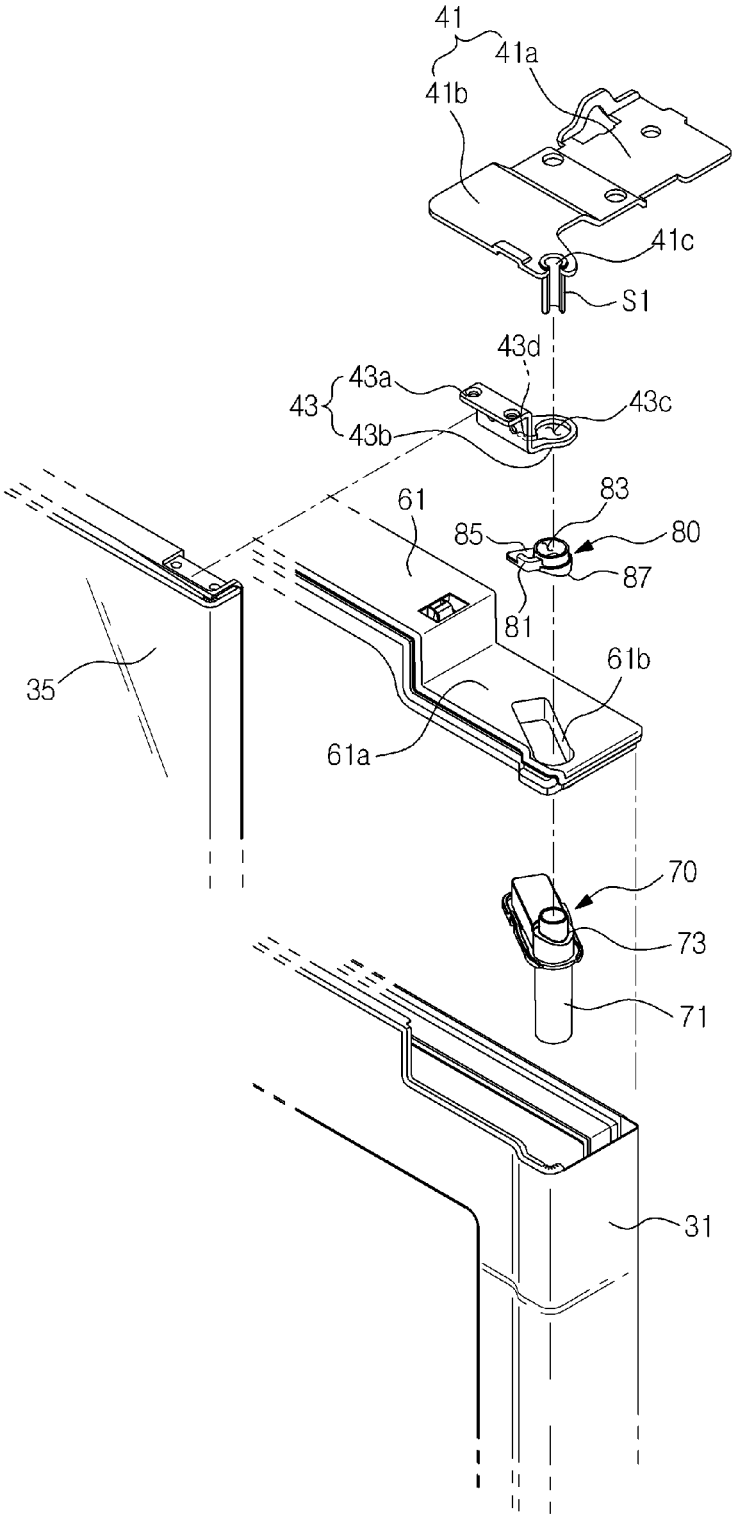
FIG. 7 is an exploded perspective view of the upper hinge of the refrigerator of FIG. 1.
Figure 8:
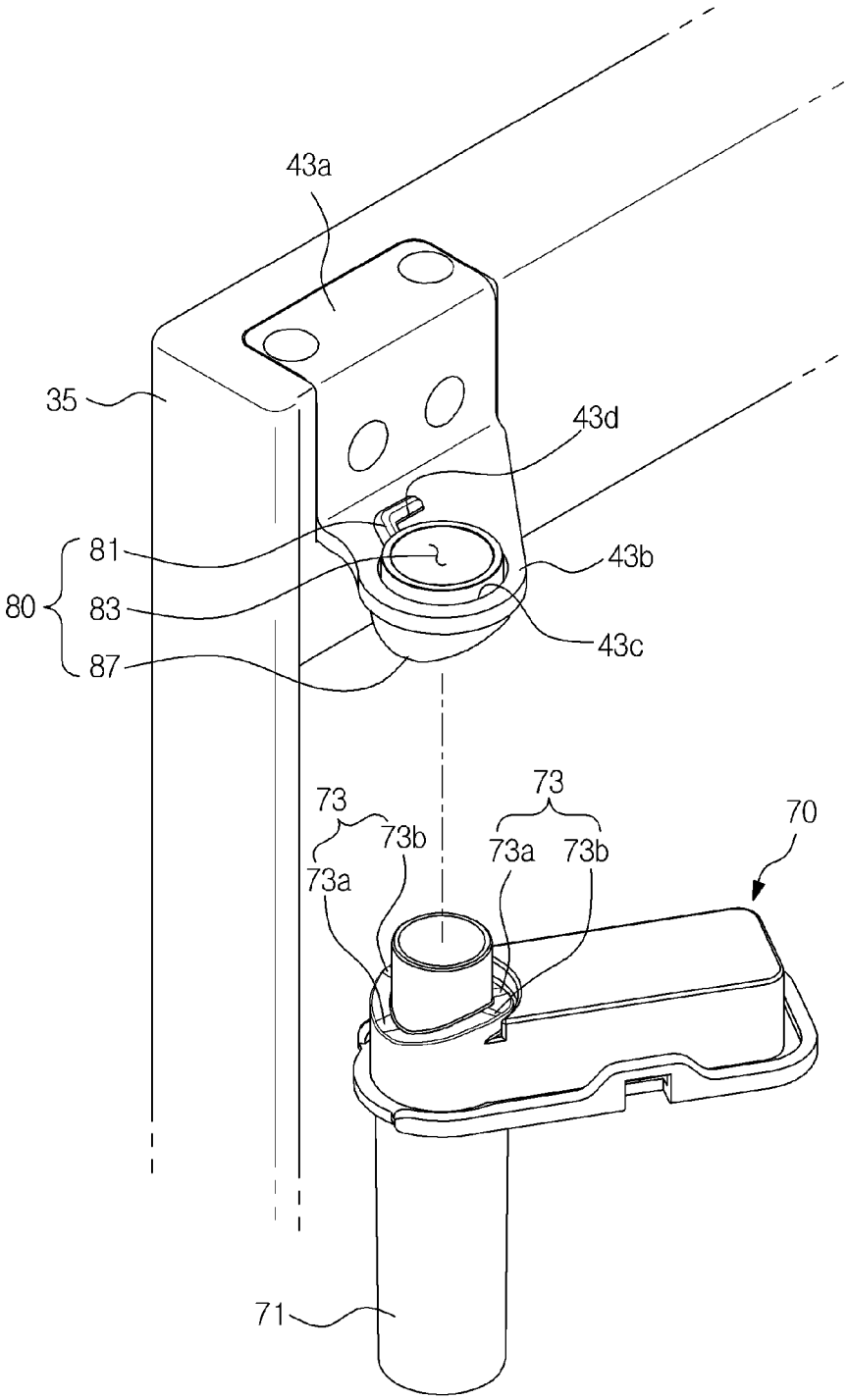
FIG. 8 is a view illustrating a state in which a cam unit and a first connector are coupled to a second upper hinge of the refrigerator of FIG. 1.

FIG. 7 is an exploded perspective view of the upper hinge of the refrigerator of FIG. 1, and FIG. 8 is a view illustrating a state in which the cam unit and the first connector are coupled to a second upper hinge of the refrigerator of FIG. 1.

As illustrated in FIGS. 7 through 8, the upper hinge 40 includes a first upper hinge 41 that allows the inner door 31 to be rotatably coupled to the body 10 and a second upper hinge 43 that allows the outer door 35 to be rotatably coupled to the inner door 31.

The first upper hinge 41 includes a first coupling part 41*a* coupled to the upper portion of the body 10 and a first extension part 41*b* that extends from the first coupling part 41*a* to the inner door 31 and is rotatably coupled to the inner door 31 due to an upper hinge shaft S1.

The first extension part 41*b* has a coupling hole 41*c* to which the upper hinge shaft S1 is coupled.

The second upper hinge 43 includes a second coupling part 43*a* coupled to an upper portion of the outer door 35 and a second extension part 43*b* that extends from the second coupling part 43*a* to the inner door 31 and is rotatably coupled to the upper hinge shaft S1 coupled to the first upper hinge 41.

The second extension part 43*b* has a first insertion hole 43*c* into which the upper hinge shaft S1 is rotatably inserted. The first insertion hole 43*c* is provided in a position corresponding to the coupling hole 41*c* of the first upper hinge 41 to which the upper hinge shaft S1 is coupled.

A connector coupling part 43*d* is provided in the first insertion hole 43*c* and extends from the first insertion hole 43*c* to have a curved shape so that the first connector 80 that will be described below may be coupled to the connection coupling part 43*d* so as to be movable in a vertical direction.

The first upper hinge 41 that allows the inner door 31 to be rotatably coupled to the body 10 and the second upper hinge 43 that allows the outer door 35 to be rotatably coupled to the inner door 31 are provided to be rotated on an upper hinge shaft S1.

The door caps 60 coupled to the upper and lower portions of the inner door 31 include an upper door cap 61 coupled to the upper portion of the inner door 31 and a lower door cap 63 coupled to the lower portion of the inner door 31.

A hinge accommodation part 61*a* in which the first extension part 41*b* of the first upper hinge 41 and the second extension part 43*b* of the second upper hinge 43 are accommodated, is provided on the upper door cap 61.

A cam unit coupling part 61*b* to which the cam unit 70 having an insertion tube 71 into which the upper hinge shaft S1 is rotatably inserted is coupled, is provided in the hinge accommodation part 61*a*.

The outer door 35 that is rotatably coupled to the inner door 31 has an auto closing structure due to the cam unit 70 and the first connector 80.

The cam unit 70 includes the insertion tube 71 into which the upper hinge shaft S1 is rotatably inserted and a first cam surface 73 formed around a circumference of the insertion tube 71.

The first cam surface 73 includes a plurality of concave parts 73*a* that face each other and convex parts 73*b* provided between the concave parts 73*a*. For example, the first cam surface 73 includes two concave parts 73*a* that face each other and convex parts 73*b* is provided between the concave parts 73*a*.

The first connector 80 is coupled to the second upper hinge 43 so as to be movable in the vertical direction, and to couple of the first connector 80, the connector coupling part 43*d* that extends from the first insertion hole 43*c* to have a curved shape is provided on the second extension part 43*b* of the second upper hinge 43.

The first connector 80 includes a coupling protrusion 81 having a shape corresponding to the connector coupling part 43*d* so that the coupling protrusion 81 may be coupled to the connector coupling part 43*d* so as to be movable in the vertical direction, a second insertion hole 83 into which the upper hinge shaft S1 is rotatably inserted, a hanging part 85 that limits the moving distance of the first connector 80 in an upward direction, and a protrusion part 87 that is provided to have a shape corresponding to the first cam surface 73 and moves along the first cam surface 73.

Since the coupling protrusion 81 and the connector coupling part 43*d* to which the coupling protrusion 81 is coupled are provided to have curved shapes, the first connector 80 coupled to the connector coupling part 43*d* is movable only in the vertical direction.

The second insertion hole 83 of the first connector 80 is provided to have a smaller diameter than that of the first insertion hole 43*c* of the second upper hinge 43 so that the first connector 80 may be coupled to the second upper hinge 43 so as to be movable in the vertical direction.

Also, the second insertion hole 83 is provided to have a larger diameter than that of the upper portion of the insertion tube 71 of the cam unit 70 so that the first connector 80 is movable in the vertical direction.

The hanging part 85 is provided to limit a distance at which the first connector 80 moving in the vertical direction moves in the upward direction to a predetermined portion so that the first connector 80 may be maintained with being coupled to the second upper hinge 43 without being deviated therefrom.

Figure 9:
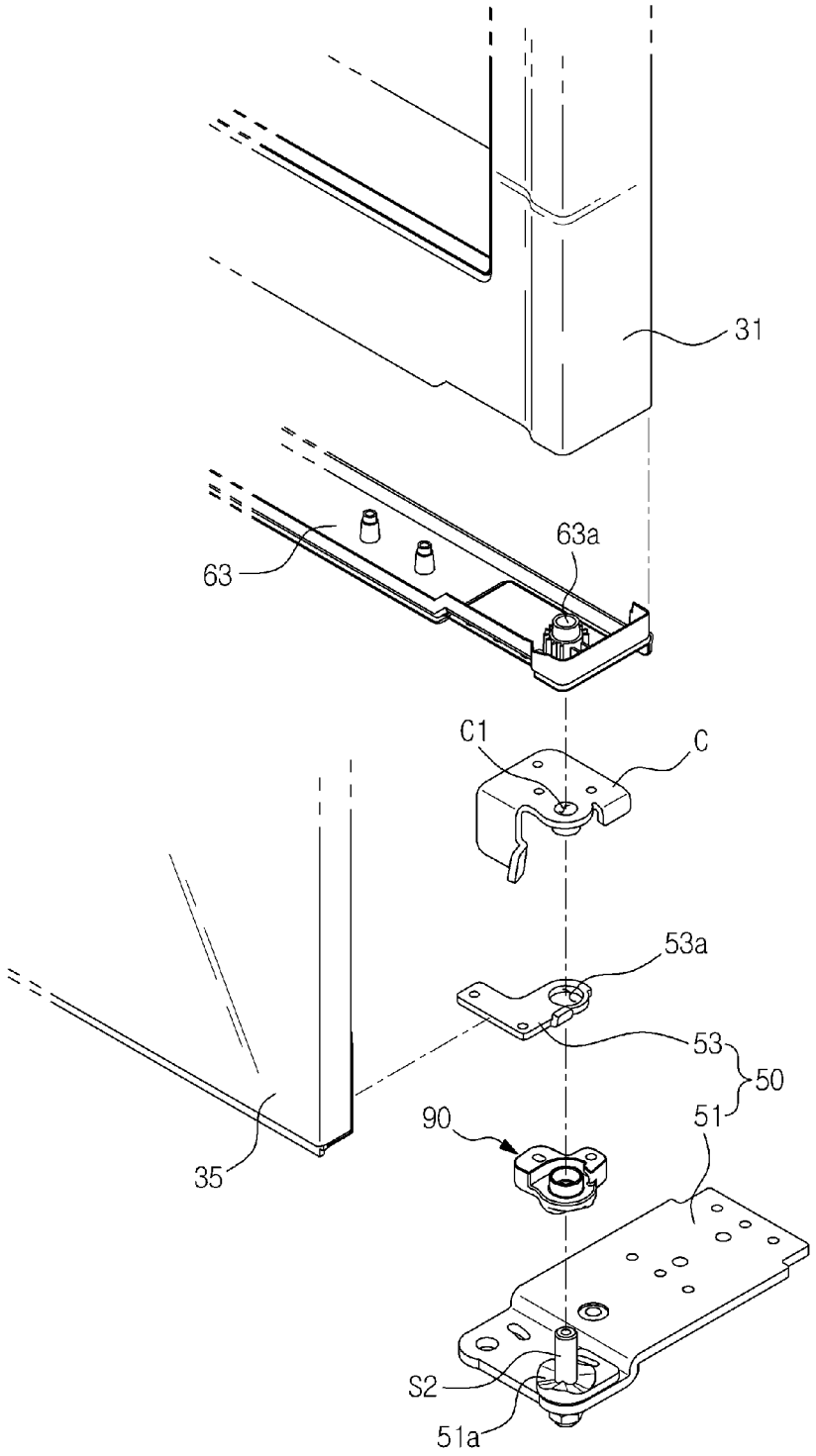
FIG. 9 is an exploded perspective view of the lower hinge of the refrigerator of FIG. 1.

FIG. 9 is an exploded perspective view of the lower hinge of the refrigerator of FIG. 1, and FIGS. 10 through 13 illustrate an operation of automatically closing the outer door due to the cam unit and the first connector of the refrigerator of FIG. 1.

Figure 10:
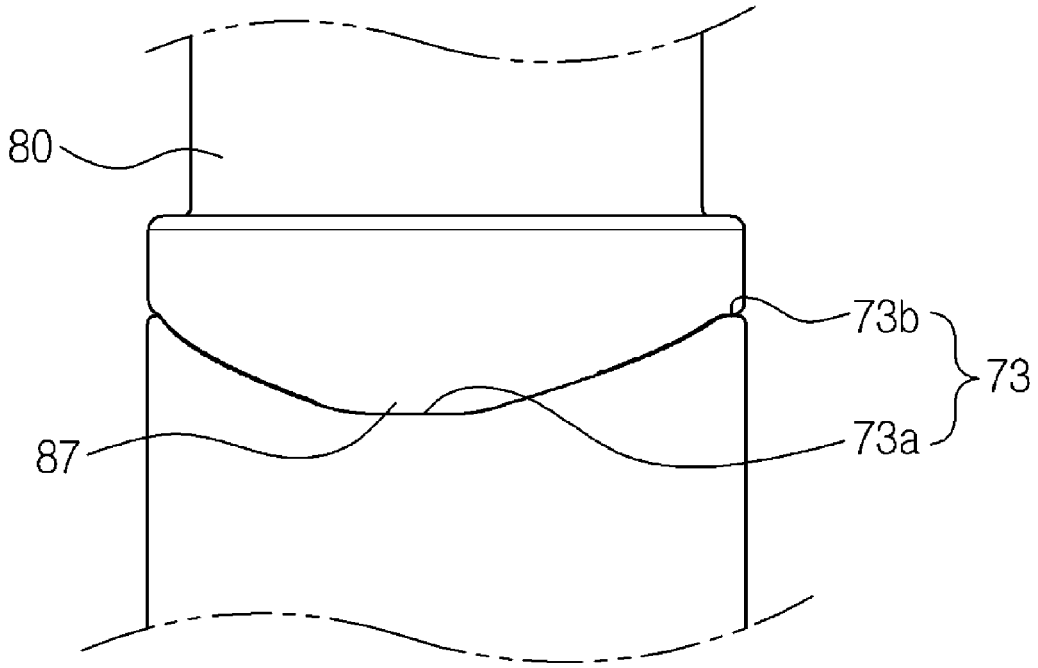
FIGS. 10 through 13 illustrate an operation of automatically closing the outer door due to the cam unit and the first connector of the refrigerator of FIG. 1.

Describing a structure in which the outer door 35 is closed in a state in which a predetermined portion of the outer door 35 is opened due to the cam unit 70 and the first connector 80, as illustrated in FIG. 10, when the outer door 35 is closed, a convex part of the protrusion part 87 of the first connector 80 is maintained with contacting the concave parts 73*a* of the first cam surface 73.

Figure 11:
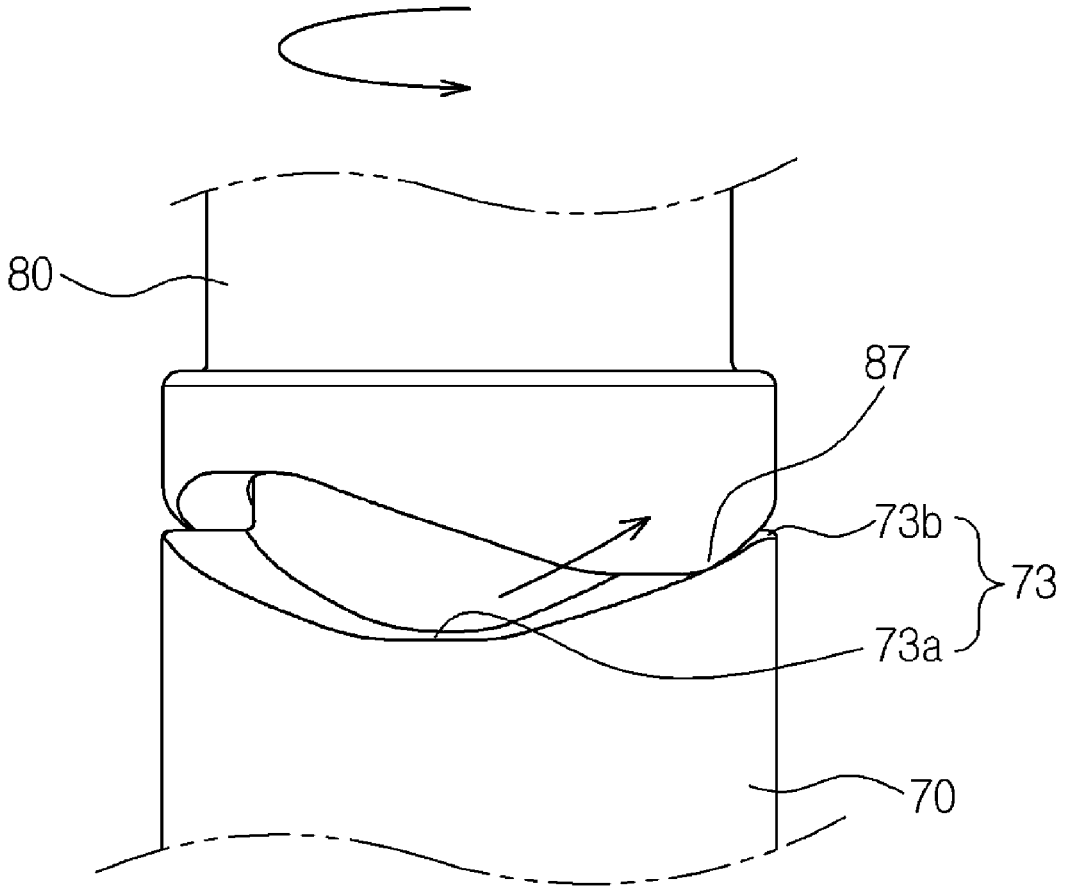

When the outer door 35 is opened, as illustrated in FIG. 11, a convex part of the protrusion part 87 of the first connector 80 that rotates together with the outer door 35 moves from the concave parts 73*a* of the first cam surface 73 to the convex parts 73*b* of the first cam surface 73 in the upward direction.

Figure 12:
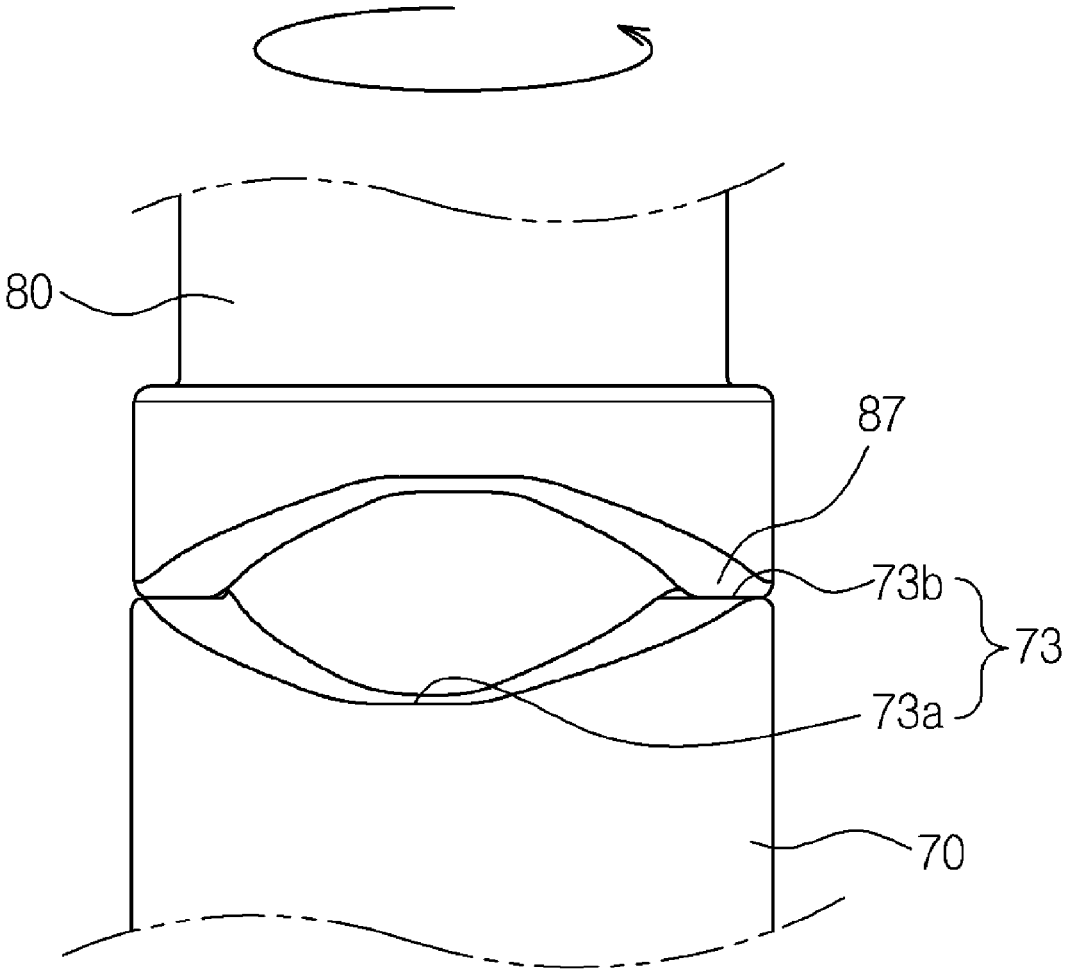

When the outer door 35 is opened about 90 degrees, as illustrated in FIG. 12, a convex part of the protrusion part 87 of the first connector 80 that rotates together with the outer door 35 and moves in the upward direction, moves up to upper portions of the convex parts 73*b* of the first cam surface 73.

In a state in which the convex part of the protrusion part 87 moves to the upper portions of the convex parts 73*b* of the first cam surface 73, due to gravity, the convex part of the protrusion part 87 moves from the convex parts 73*b* to the concave parts 73*a*, and the first connector 80 moves in a downward direction.

Figure 13:
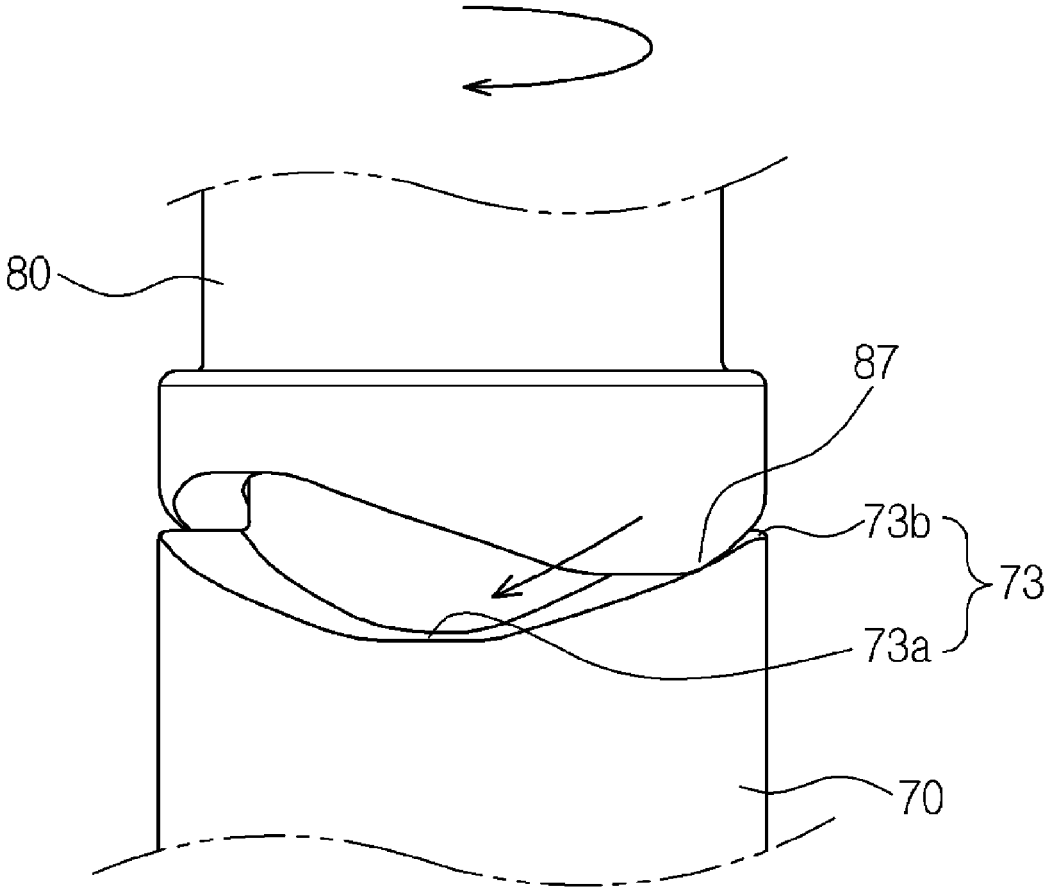

When the first connector 80 moves in the downward direction, as illustrated in FIG. 13, the first connector 80 rotates in a direction in which the outer door 35 is closed, which is opposite to a direction in which the outer door 35 is opened. The first connector 80 transmits a rotational force to the outer door 35 in the direction in which the outer door 35 is closed, so that the outer door 35 may be automatically closed.

Although not specifically shown, a hinge that allows the freezer compartment door 33 to be rotatably coupled to the body 10 has a structure in which the second upper hinge 43 coupled to the outer door 35 is omitted from the configuration of the upper hinge 40 that allows the refrigerator compartment door 31 as the inner door to be rotatably coupled to the body 10. Since there is no outer door 35, the configuration of the cam unit 70 and the first connector 80 that allow the outer door 35 to have an auto closing function may be omitted.

As illustrated in FIG. 9, the lower hinge 50 that allows the inner door 31 and the outer door 35 to be rotatably coupled to the body 10 is coupled to the lower portion of the body 10.

The lower hinge 50 includes a first lower hinge 51 that is coupled to the lower portion of the body 10 and allows the inner door 31 to be rotatably coupled to the body 10 and a second lower hinge 53 that is coupled to the lower portion of the outer door 35 and allows the outer door 35 to be rotatably coupled to the inner door 31.

The first lower hinge 51 and the second lower hinge 53 that constitute the lower hinge 50 are provided to be rotated on an lower hinge shaft S2, similar to the upper hinge 40.

A lower door cap 63 is coupled to a lower portion of the inner door 31, and an insertion part 63*a* into which the lower hinge shaft S2 is inserted is provided in the lower door cap 63.

The lower hinge shaft S2 is coupled to the first lower hinge 51, and a coupling unit C having a third insertion hole C1 into which the lower hinge shaft S2 is rotatably inserted, is coupled to a lower portion of the lower door cap 63.

A fourth insertion hole 53*a* into which the lower hinge shaft S2 is rotatably inserted is provided in the second lower hinge 53 coupled to the lower portion of the outer door 35.

In order for the inner door 31 to have an auto closing structure, a second cam surface 51*a* is formed on the first lower hinge 51, and a second connector 90 is coupled to the coupling unit C, moves along the second cam surface 51*a*, and transmits a rotational force in a direction in which the inner door 31 is closed.

As described above, in a refrigerator according to the one or more embodiments of the present disclosure, consumers' conveniences are maximized, a loss of cold air is minimized, and an outer door may be rotated on the same hinge shaft as that of an inner door so that an auto closing structure of the outer door may be realized using only a simple structure.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body having a refrigerator compartment;

an inner door that opens/closes the refrigerator compartment, the inner door having an opening;

an outer door that opens/closes the opening;

a first upper hinge that is coupled to a top portion of the body and is rotatably coupled to the inner door via an upper hinge shaft, the first upper hinge having a coupling hole to which the upper hinge shaft is coupled;

a second upper hinge that is coupled to a top portion of the outer door and is rotatably coupled to the inner door via the upper hinge shaft, the second upper hinge having a first insertion hole into which the upper hinge shaft is rotatably inserted and provided in a position corresponding to the coupling hole;

a cam unit that comprises an insertion tube into which the upper hinge shaft is rotatably inserted and a first cam surface formed along a circumference of the insertion tube; and a first connector that is rotatable around a vertical axis of the upper hinge shaft, the first connector comprising a coupling protrusion coupled to the second upper hinge;

a hanging part provided to limit a vertical travel of the first connector up to the second upper hinge;

a second insertion hole into which the upper hinge shaft is rotatably inserted; and a protrusion part that is provided to have a shape corresponding to the first cam surface and moves along the first cam surface, the first connector being configured to transmit a rotational force to the outer door in a direction in which the outer door is closed, and the second insertion hole has a smaller diameter than a diameter of the first insertion hole, wherein an upper door cap having a hinge accommodation part that accommodates a portion of the first upper hinge and a portion of a second upper hinge is coupled to an upper portion of the inner door, a cam unit coupling part to which the cam unit is coupled is provided in the hinge accommodation part, and an upper portion of the insertion tube of the cam unit is provided to have a smaller diameter than a diameter of the second insertion hole so that the first connector is movable on the vertical axis.

2. The refrigerator according to claim 1, wherein a connector coupling part is provided in the first insertion hole and extends from the first insertion hole to have a curved shape so that the first connector is coupled to the connector coupling part so as to be movable on the vertical axis, and the coupling protrusion is provided to have a shape corresponding to the connector coupling part.

3. The refrigerator according to claim 1, wherein the first cam surface comprises a plurality of concave parts that face each other, and convex parts are provided between the concave parts.

4. The refrigerator according to claim 3, wherein the protrusion part of the first connector provided to have a shape corresponding to the first cam surface is disposed so that, if the outer door is closed, a convex part of the protrusion part contacts the concave parts.

5. The refrigerator according to claim 4, wherein, if the outer door is opened, the convex part of the protrusion part moves from the concave parts to the convex parts of the first cam surface, and the first connector moves in the upward direction on the vertical axis.

6. The refrigerator according to claim 5, wherein, if the outer door is opened about 90 degrees, the convex part of the protrusion part moves to upper portions of the convex parts of the first cam surface and moves to the concave parts due to gravity, and the first connector moves in the downward direction on the vertical axis.

7. The refrigerator according to claim 6, wherein the first connector moves in the downward direction on the vertical axis and transmits a rotational force to the outer door in the direction in which the outer door is closed such that the outer door is closed.

8. The refrigerator according to claim 1, wherein a lower door cap is coupled to a lower portion of the inner door, and an insertion part into which a lower hinge shaft is inserted is provided in the lower door cap.

9. The refrigerator according to claim 8, wherein a first lower hinge to which the lower hinge shaft is coupled is coupled to a lower portion of the body, and a coupling unit having a third insertion hole into which the lower hinge shaft is rotatably inserted is coupled to a lower portion of the lower door cap.

10. The refrigerator according to claim 9, wherein a second lower hinge having a fourth insertion hole into which the lower hinge shaft is rotatably inserted is coupled to a lower portion of the outer door.

11. The refrigerator according to claim 10, wherein a second cam surface is provided on the first lower hinge, and a second connector is coupled to the coupling unit, moves along the second cam surface, and transmits a rotational force to the inner door in a direction in which the inner door is closed.

12. A refrigerator comprising:

a body;

a storage compartment that is provided in the body so that a front portion of the storage compartment is opened and comprises a refrigerator compartment and a freezer compartment;

an inner door that is provided to have an opening having a size corresponding to the refrigerator compartment and opens/closes the refrigerator compartment, the opening having a plurality of door guards;

an outer door that opens/closes the opening;

an upper hinge comprising a first upper hinge that is coupled to an upper portion of the body and allows the inner door to be rotatably coupled to the body and a second upper hinge that is coupled to an upper portion of the outer door and allows the outer door to be rotatably coupled to the inner door; and a lower hinge comprising a first lower hinge that is coupled to a lower portion of the body and allows the inner door to be rotatably coupled to the body and a second lower hinge that is coupled to a lower portion of the outer door and allows the outer door to be rotatably coupled to the inner door, wherein the outer door is automatically closed due to a cam unit coupled to an upper portion of the inner door and having a first cam surface and a first connector that is coupled to the second upper hinge, moves along the first cam surface on a vertical axis, and transmits a rotational force to the outer door in a direction in which the outer door is closed, and the inner door is automatically closed due to a second cam surface formed on the first lower hinge and a second connector that moves along the second cam surface and transmits a rotational force to the inner door in a direction in which the inner door is closed.

13. The refrigerator according to claim 12, wherein the first upper hinge and the second upper hinge share an upper hinge shaft as one hinge shaft, and the first lower hinge and the second lower hinge share a lower hinge shaft as one hinge shaft.

* * * * *